US009474667B1

(12) United States Patent
Gruber

(10) Patent No.: US 9,474,667 B1
(45) Date of Patent: Oct. 25, 2016

(54) WHEELCHAIR CONTAMINATION SHIELD WITH MOUNTING SYSTEM

(71) Applicant: Jason Gruber, Tampa, FL (US)

(72) Inventor: Jason Gruber, Tampa, FL (US)

( * ) Notice: Subject to any disclaimer, the term of this patent is extended or adjusted under 35 U.S.C. 154(b) by 0 days.

(21) Appl. No.: 14/818,346

(22) Filed: Aug. 5, 2015

(51) Int. Cl.
*A61G 5/10* (2006.01)
*A61G 5/02* (2006.01)

(52) U.S. Cl.
CPC .. *A61G 5/10* (2013.01); *A61G 5/02* (2013.01)

(58) Field of Classification Search
CPC .. A61G 5/10; A61G 5/02; A61G 2005/1054; A61G 2005/128
USPC ..... 293/112, 115, 128, DIG. 1
See application file for complete search history.

(56) References Cited

U.S. PATENT DOCUMENTS 1,048,894 A 12/1912 Schickel
1,753,519 A 4/1930 Kanner
2,876,486 A 3/1959 Lindstrom
3,103,369 A 9/1963 Gaines
3,231,293 A * 1/1966 Loustaunau ..... A61G 5/10 15/160
4,351,540 A * 9/1982 Minnebraker ..... A61G 5/00 280/250.1
D277,089 S * 1/1985 Tosti ..... D12/107
4,593,929 A * 6/1986 Williams ..... A61G 5/00 16/DIG. 24
4,754,987 A * 7/1988 Williams ..... A61G 5/00 280/304.1
D377,375 S * 1/1997 Liu ..... D12/130
5,775,454 A 7/1998 Scherbarth
5,857,538 A * 1/1999 Chambers ..... B62K 25/283 180/219
6,176,335 B1 * 1/2001 Schaffner ..... A61G 5/043 180/65.1
6,312,000 B1 * 11/2001 Pauls ..... A61G 5/043 180/907
6,439,281 B1 8/2002 Hogg
6,598,947 B2 7/2003 Hannah
D489,029 S * 4/2004 Waters ..... D12/1
D521,909 S * 5/2006 Gillett ..... D12/133
D523,788 S * 6/2006 Jones ..... D12/131
8,172,246 B2 5/2012 Bybee
8,544,865 B1 * 10/2013 Janikowski ..... A61G 5/10 150/166
2002/0125711 A1 * 9/2002 Calhoun ..... A61G 5/028 280/848
2003/0037852 A1 * 2/2003 Hannah ..... A61G 5/10 152/170
2008/0203702 A1 * 8/2008 Noye ..... A61G 5/02 280/304.1
2014/0265238 A1 * 9/2014 Storm ..... A61G 5/10 280/304.1
2014/0265510 A1 * 9/2014 Storm ..... A61G 5/10 297/423.4

OTHER PUBLICATIONS

Protex Colours Wheelchair.
Slender Fender.
The Hand-Defender, Consumer Version—YouTube video.

* cited by examiner

*Primary Examiner* — Kevin Hurley
*Assistant Examiner* — Gabriela C Craciun
(74) *Attorney, Agent, or Firm* — Larson & Larson, P.A.; Justin P. Miller; Patrick A. Reid

(57) ABSTRACT

The disclosed Wheelchair Contamination Shield is a fender for a wheelchair that covers a large portion of the tire, protects the user's fingers from contact with tire. Further, the Wheelchair Contamination Shield prevents fingers from being caught in gap between hand rim and wheel, where contact with the rotating standoffs can be harmful.
The mounting system of the Wheelchair Contamination Shield optionally includes removable foam blocks and arcuate mounting slots. The combination of these elements simplifies the process of mounting the device on the wheelchair.

11 Claims, 9 Drawing Sheets

WHEELCHAIR CONTAMINATION SHIELD WITH MOUNTING SYSTEM

FIELD

This invention relates to the field of wheelchairs and more particularly to a device to shield a user from contaminants while using a wheelchair.

BACKGROUND

Manually propelled wheelchairs all center on the use of two large wheels. The wheelchair is propelled by the user, the user's hands propelling the wheelchair by manually turning a hand rim attached to each wheel.

This hand rim is directly adjacent to the tire, just outside the wheel. As a result the user's hand crosses and rests on the tire.

This constant contact between the user's hand and the tire acts as a conduit for contaminants. The tires of a wheelchair are analogous to its shoes. The tires come into contact with all the surfaces the user encounters in a day, including those of the home, workplace, hospital, public spaces, and so forth.

In these locations the floor may be covered with many types of contaminants, both chemical and biological. For users who require help moving the wheelchair, the tires also come into contact with the individual pushing the wheelchair from behind. The tires further come into contact with any blanket, backpack, jacket, or other material that drapes over the rear of the wheelchair.

What is needed is a wheelchair tire guard that mounts to all types of wheelchairs, shielding the user's hand from the tires.

SUMMARY

The disclosed Wheelchair Contamination Shield is a fender for a wheelchair that covers substantially half of the tire, protecting the user's hands from contact with the tire. Further, the Wheelchair Contamination Shield prevents fingers from being caught in the gap between hand rim and wheel, where contact with the rotating standoffs can be harmful.

The mounting system of the Wheelchair Contamination Shield optionally includes removable foam blocks and arcuate mounting slots. The combination of these elements simplifies the process of mounting the device on any wheelchair.

Shape and Resulting Coverage Area

The Wheelchair Contamination Shield provides numerous benefits to the user as it relates to her interaction with the wheels and hand rim of a manually propelled wheelchair.

First, the Wheelchair Contamination Shield surrounds substantially half of the tire of a wheelchair, thereby covering substantially all the sections that a user or caregiver may come into contact with. Merely covering the front of the wheelchair tire fails to protect any caregivers behind the wheelchair, and fails to prevent contamination of blankets or other objects draped across the rear of the wheelchair.

Wheelchairs are often manipulated by caregivers who are positioned behind the wheelchair. The clothing or legs of such caregivers may come into contact with the wheelchair, including its tires. As a result, the caregivers are at risk of receiving infections carried from the floor by the tires to their clothing or legs.

Additionally, wheelchair users often have clothing or blankets draped over the rear of the wheelchair. This clothing or blanket can rub against the wheel, resulting in accumulated contaminants coming into contact with the user in a bed or chair. The extension of the device to cover the rear of the tire protects against this contamination.

Second, the Wheelchair Contamination Shield wraps around the outer portion of the tire, preventing user contact with the side of the tire. This extension continues, bridging the gap between the wheel and the hand rim, preventing the fingers of the user from becoming trapped in this space, and then caught by the standoffs that join the hand rim and wheel.

This transition portion, or flared portion, leaves the hand rim accessible to the user. Furthermore, the user's thumb rests against this section of the Wheelchair Contamination Shield, allowing the fingers to ride against the hand rim without fear of being caught.

The resulting shape is the combination of a half circle formed by the sidewall joined to a curved trough, channel, or inverted U-shape that makes up the portion covering the tire of the wheelchair. The curved trough, channel, inverted U-shape, or portion covering the tire by curving inwardly, preferably encloses greater than 40% of the tire.

Stated differently, the shape is that of a vertical wall having a curved top and a flat bottom, with an inwardly facing channel following the shape of the curved top.

Mounting

The Wheelchair Contamination Shield is designed to be simple for any user to mount, regardless of skill level. Given the variation in user skill, and the variation in wheelchair design, a universal mounting system is important.

Optional curved/arcuate slots in the sidewall, or vertical wall, of the Wheelchair Contamination Shield provide locations to interface mounting brackets to the frame of the wheelchair. The use of multiple slots, and the curved shape, makes mounting simple for users.

The Wheelchair Contamination Shield can be provided to a user with fasteners already loosely mounted in the curved slots. The user can then place the Wheelchair Contamination Shield over a wheel, move the fastener along the slot until the frame is overlapped, and then tighten down the fasteners.

The result is simplified mounting, as compared to competing systems where mounting hardware is confined to individual holes.

In addition to the curved slots, optional mounting blocks may also be provided. The mounting blocks center the Wheelchair Contamination Shield with respect to the tire, holding the Wheelchair Contamination Shield in place to allow the user to install the mounting clips without having to simultaneously support the weight of the Wheelchair Contamination Shield.

The mounting blocks can be made of a compressible material, such as foam, or a stiffer material, such as plastic. The mounting blocks can be: integral to the Wheelchair Contamination Shield and broken off after mounting; attached to the Wheelchair Contamination Shield using an adhesive; provided as a separate piece for use during installation; physically interfaced to the Wheelchair Contamination Shield using, for example, a hole and a barbed connection; or other means of holding the mounting block to the Wheelchair Contamination Shield.

By placing removable blocks at each end of the fender, when placed over the tire the fender self-centers left/right, as well as up/down.

Mounting blocks made of compressible materials are preferable because this allows the user to wedge the Wheelchair Contamination Shield against the tire, seating it in place for a firm position during mounting. But firm materials may also be used in less preferable embodiments, or firm materials may take on flexible shapes that allow for the wedging action to be created.

For example, a firm material may be in the shape of a hollow wedge, allowing for compression.

Following installation of the Wheelchair Contamination Shield the blocks are pulled out, and the wheel is free to rotate within the fender.

Bumper

An optional feature of the Wheelchair Contamination Shield is a bumper. The bumper provides two useful functions.

First, the bumper lies outside the hand rim, and thus outside of a user's hands. It is common for a wheelchair user to catch her knuckles on doorways or other obstructions, such as beds, end tables, and so forth, while trying to navigate through a home or business.

The bumper acts to shield the user's knuckles against this contact, preventing harm to the hand.

Second, the bumper creates a location that is easily accessible to the user. Unlike a backpack draped over the rear of the wheelchair, which is hard to reach, the Wheelchair Contamination Shield is located on the sides of the wheelchair. A bumper bag affixed to the bumper is within reach of the user, allowing the user to easily add or remove items from the bumper bag.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
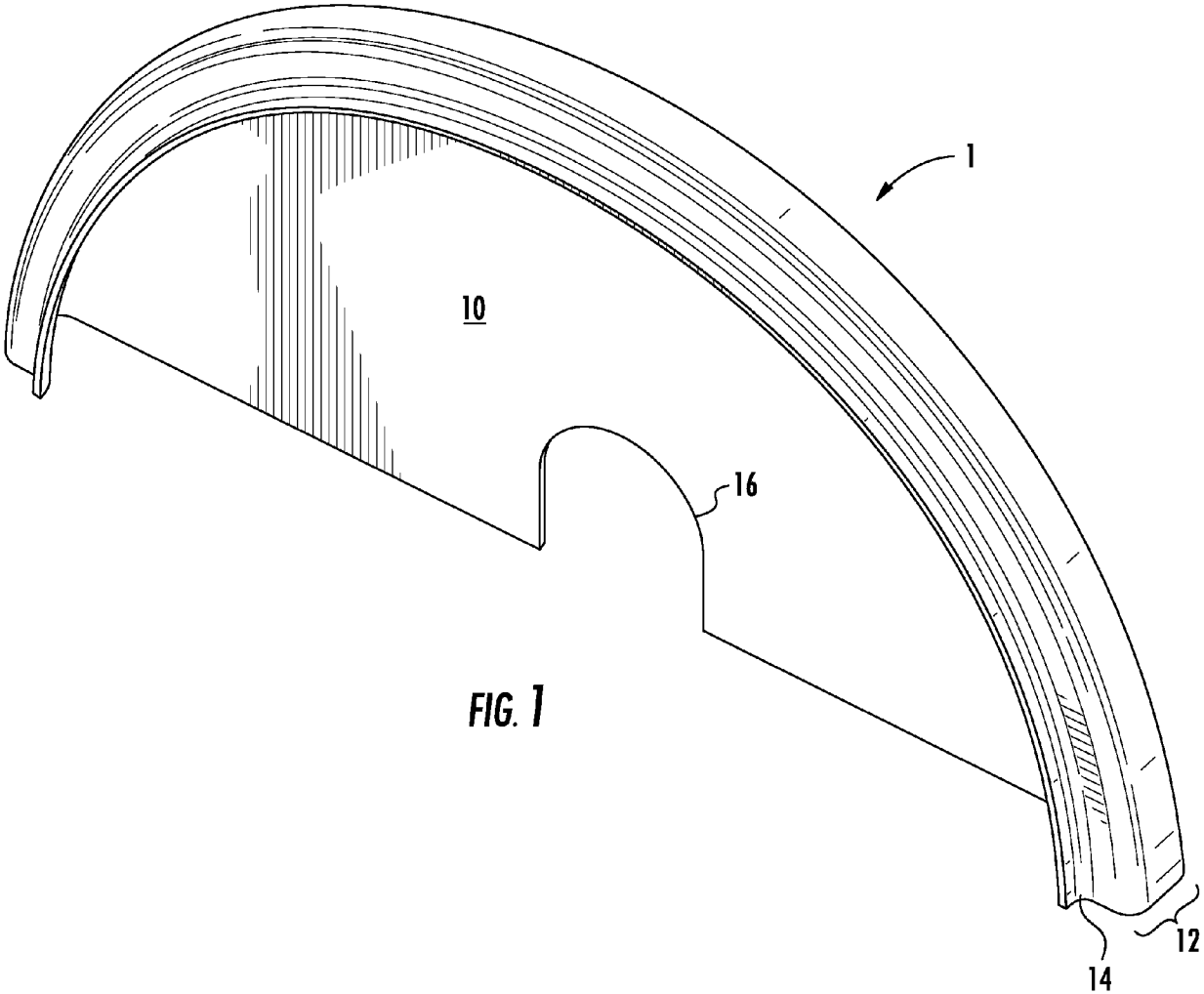
FIG. 1 illustrates an isometric view of the Wheelchair Contamination Shield

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of the Wheelchair Contamination Shield is shown. The wheelchair contamination shield 1 is shown with sidewall 10 and tire shroud 12, which includes a finger standoff guard 14. A section of the sidewall 10 is removed creating axle support cutout 16, which provides room for the hub and axle of the wheelchair.

Figure 2:
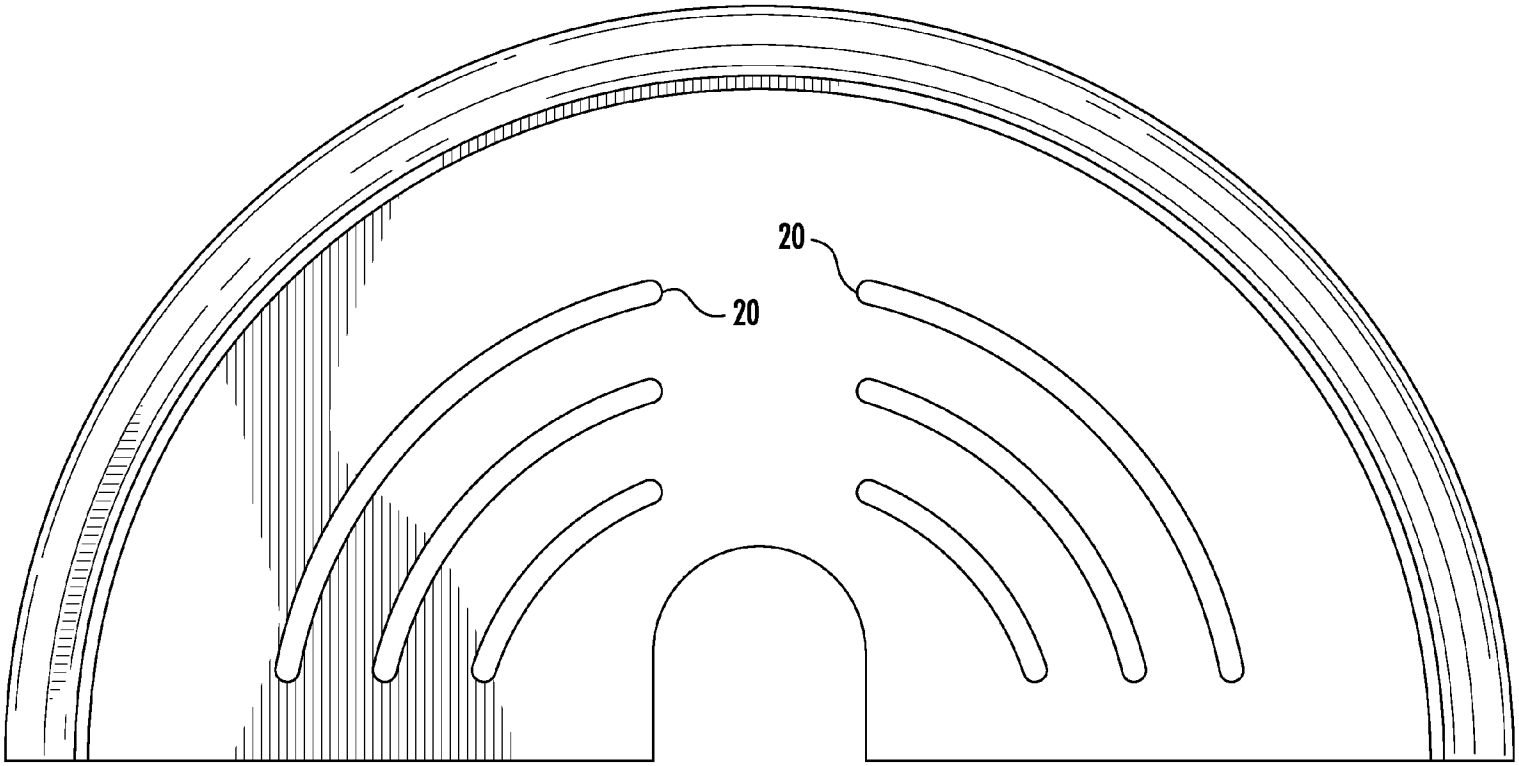
FIG. 2 illustrates a front view of the Wheelchair Contamination Shield.

Referring to FIG. 2, a front view of the Wheelchair Contamination Shield is shown. The numerous optional curved mounting slots 20 are shown, numbering six in the figure. Other numbers of curved mounting slots 20 are anticipated, the number and size being adjustable as wheelchairs vary in shape and size.

In FIG. 2 the curved mounting slots are shown in matched pairs, mirrored across the center of the wheelchair contamination shield 1.

Figure 3:
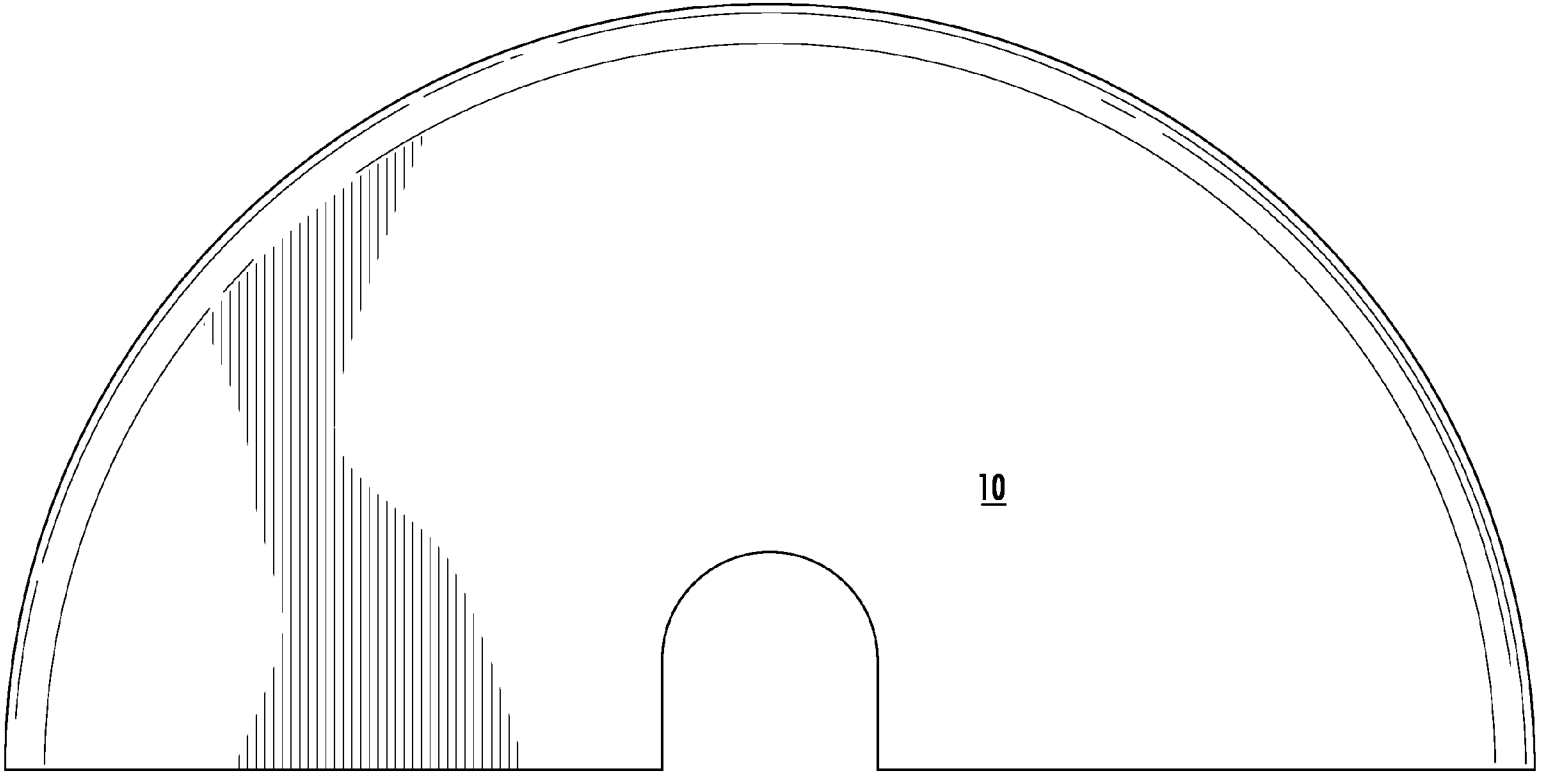
FIG. 3 illustrates a back view of the Wheelchair Contamination Shield.

Referring to FIG. 3, a back view of the Wheelchair Contamination Shield is shown. The back of the sidewall 10 is shown.

Figure 4:
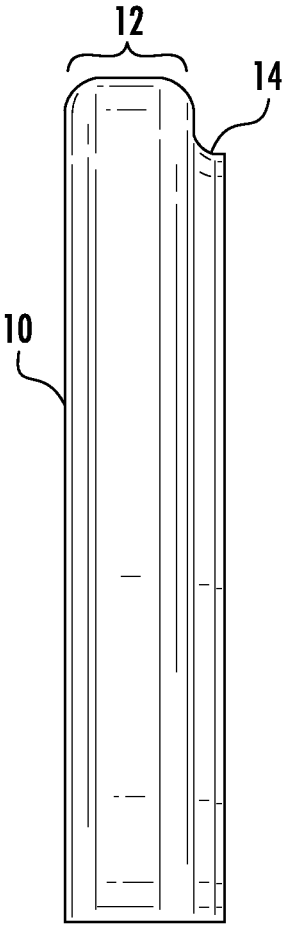
FIG. 4 illustrates a left side view of the Wheelchair Contamination Shield.
Figure 5:
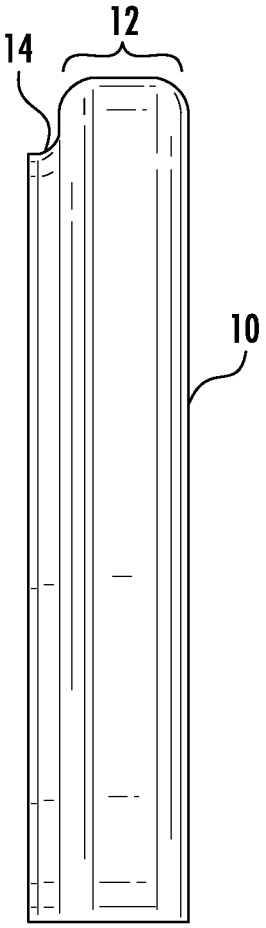
FIG. 5 illustrates a right side view of the Wheelchair Contamination Shield.

Referring to FIGS. 4 and 5, side views of the Wheelchair Contamination Shield are shown.

The tire shroud 12 is shown, which substantially follows the shape of a wheelchair tire. This shape transitions from the flat sidewall 10 to an upward curve, the upward curve ending in a flat top, followed by a downward curve, a straight section, and finally an upward curve to form the finger standoff guard 14.

Figure 6:
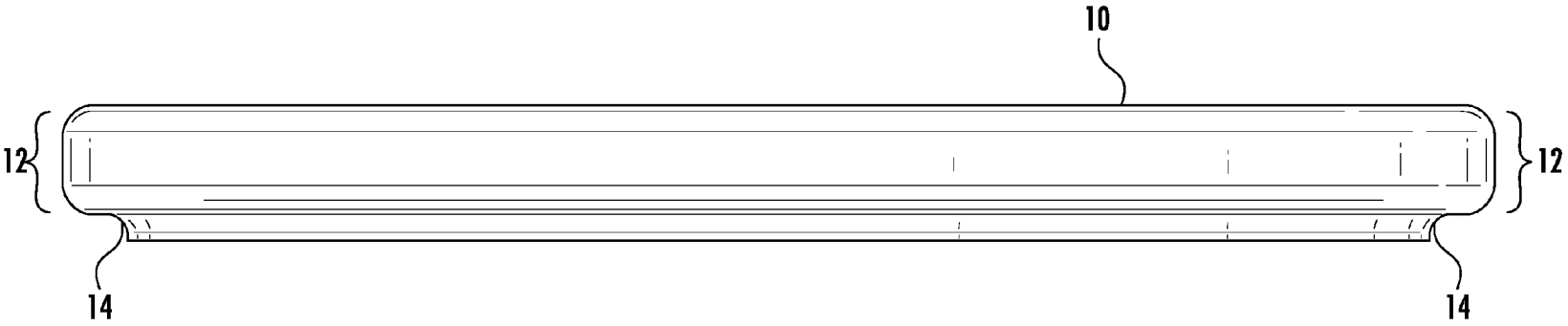
FIG. 6 illustrates a top view of the Wheelchair Contamination Shield.

Referring to FIG. 6, a top view of the Wheelchair Contamination Shield is shown.

From above it is shown that the tire shroud 12 inwardly tapers to create the finger standoff guard 14. As is shown in later figures, this is because the hand rim is a smaller diameter than the tire, and the wheelchair contamination shield 1 is shaped to fit this change in diameter.

Figure 7:
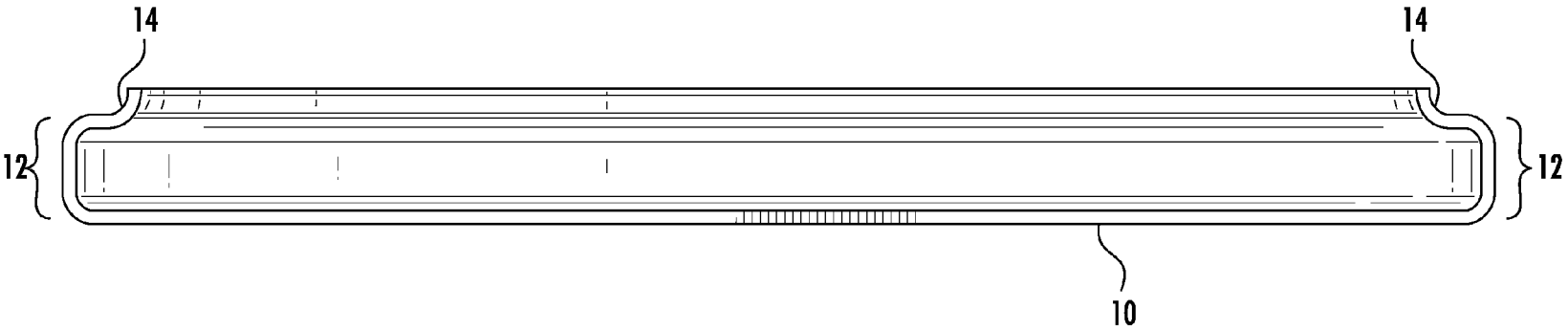
FIG. 7 illustrates a bottom view of the Wheelchair Contamination Shield.

Referring to FIG. 7, a bottom view of the Wheelchair Contamination Shield is shown. Again, the tapering effect to create the finger standoff guard 14 is shown. Further shown is the cavity created within the wheelchair contamination shield 1 to contain the wheel of the wheelchair.

Figure 8:
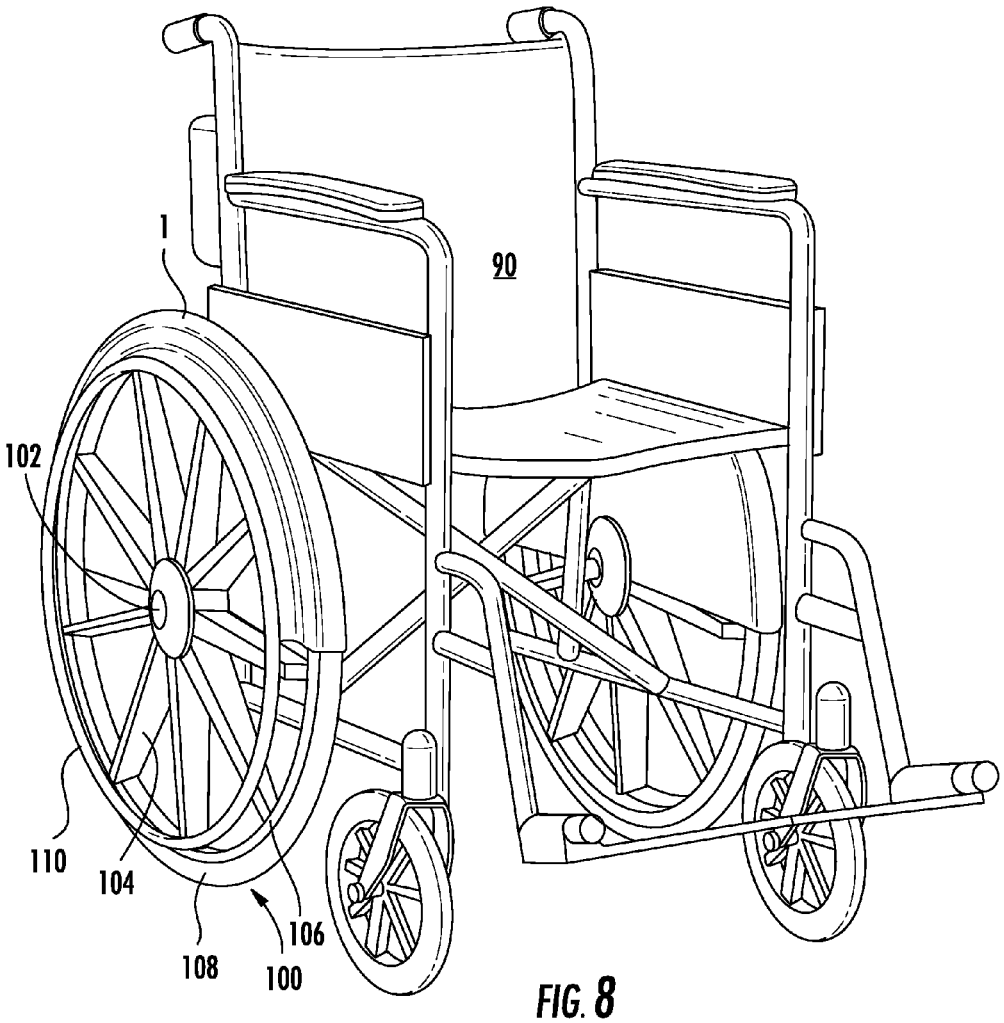
FIG. 8 illustrates a Wheelchair Contamination Shield mounted on a wheelchair.

Referring to FIG. 8, a Wheelchair Contamination Shield mounted on a wheelchair is shown. The wheelchair 90 has a pair of wheels 100, each of which has a hub 102 that joins to spokes 104 that support a rim 106. Mounted on the rim is a tire 108. Connected to the rim 106 are one or more standoffs 109 (not shown), which bridge the space between the rim 106 and the hand rim 110.

Figure 9:
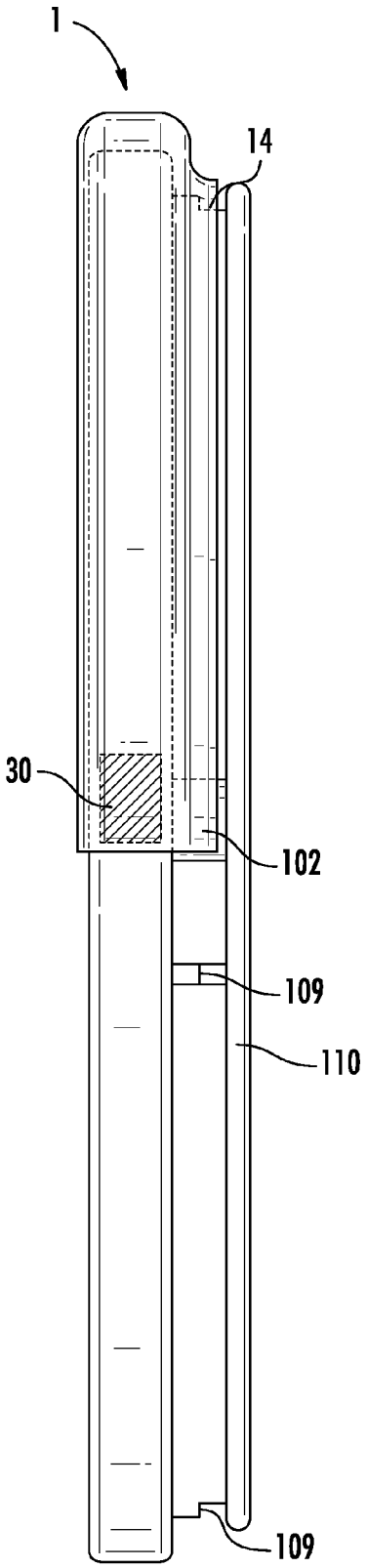
FIG. 9 illustrates a side view of the Wheelchair Contamination Shield mounted on a wheel.

Referring to FIG. 9, a side view of the Wheelchair Contamination Shield mounted on a wheel is shown.

The mounting block 30 is shown in dashed lines, given that in the side view it is hidden by the wheelchair contamination shield 1. The standoffs 109 are shown passing beneath finger standoff guard 14. It is preferable to leave a minimal gap between the finger standoff guard 14 and the hand rim 10, as is shown in FIG. 9.

Figure 10:
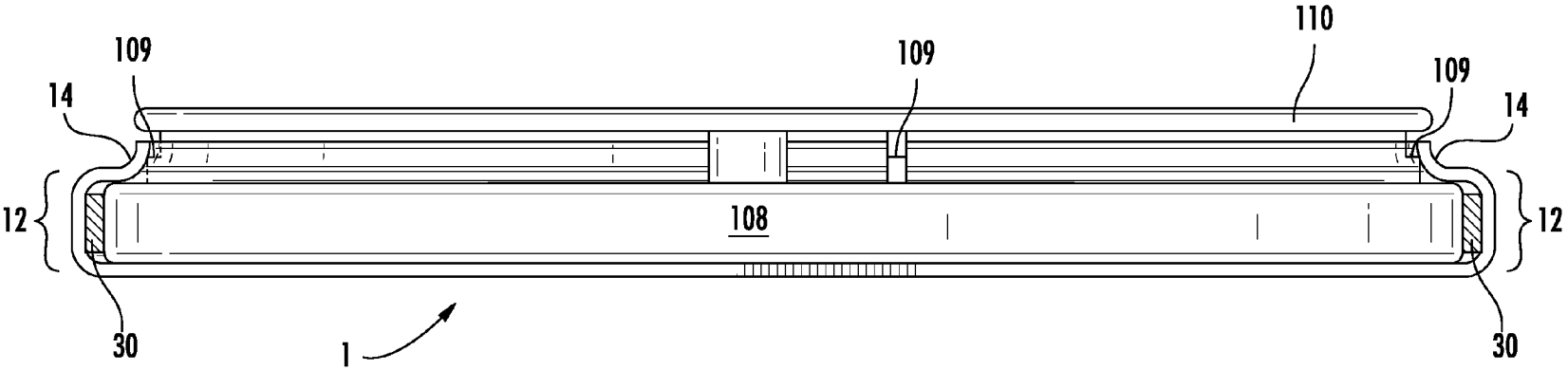
FIG. 10 illustrates a bottom view of the Wheelchair Contamination Shield mounted on a wheel.

Referring to FIG. 10, a bottom view of the Wheelchair Contamination Shield mounted on a wheel is shown. From this bottom view, both mounting blocks 30 are shown. As can be seen, the mounting blocks 30 center the wheelchair contamination shield 1 with respect to the tire 108. In this way when the wheelchair contamination shield 1 is held in place during mounting. Following installation the mounting blocks 30 are removed and the wheel 108 can spin freely within the wheelchair contamination shield 1.

Figure 11:
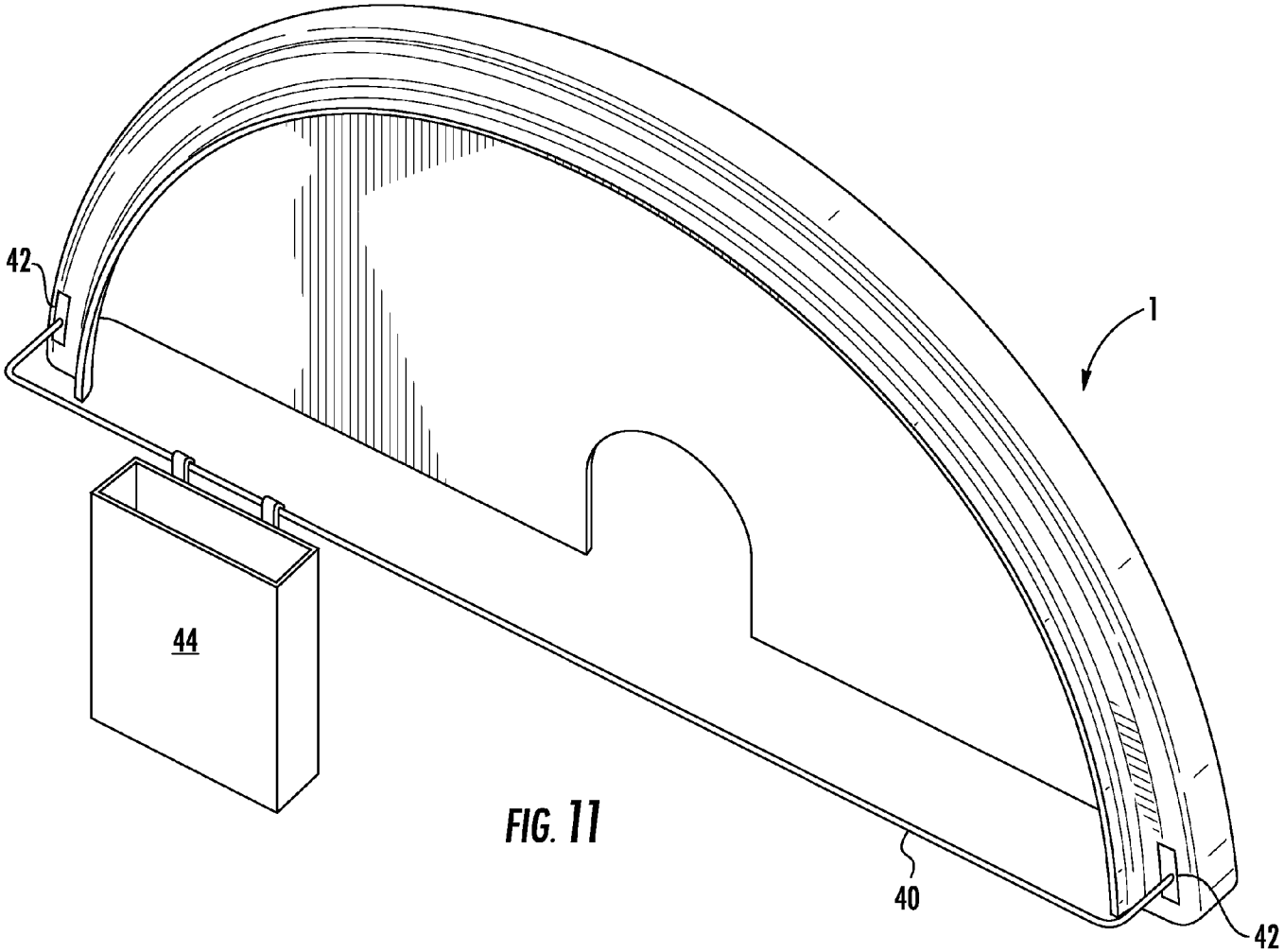
FIG. 11 illustrates an isometric view of the Wheelchair Contamination Shield with a bumper and bumper bag.

Referring to FIG. 11, an isometric view of the Wheelchair Contamination Shield with a bumper and bumper bag is shown.

The bumper 40 connects the two ends of the wheelchair contamination shield 1, each end of the bumper 40 affixed using bumper attachment hardware 42. Further shown is the optional bumper bag 44, hanging from the bumper 40.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A device to mount to a wheelchair, covering a tire of the wheelchair to prevent the spread of contamination, the device comprising:

a. a wheelchair fender;
  i. the wheelchair fender having a shape of a half circle, the half circle having a straight section and a rounded section;
  ii. a portion of the rounded section of the half circle curved inwardly to form a shroud to enclose the tire;
  iii. the shroud having two ends;
b. one or more mounting slots;
  i. the mounting slots within the half circle of the wheelchair fender;
  ii. whereby the mounting slots allow the device to mount to a variety of wheelchair frames.

2. The device of claim 1, further comprising:

a. two or more removable mounting blocks;
  i. one of the two or more removable mounting blocks temporarily affixed to the wheelchair fender at each of the two ends;
  ii. the two or more removable mounting blocks sized to fill a space between the wheelchair fender and the tire;
  iii. whereby the two or more removable mounting blocks act to center the wheelchair fender on the wheel, holding the wheelchair fender in its proper location until mounting is complete.

3. The device of claim 1, wherein:

a. the portion of the rounded section of the half circle curved inwardly to form a shroud to enclose the tire further extends to bridge any gap between the tire and a hand rim;
b. whereby a user's fingers are protected from hard caused by being trapped between the tire and hand rim.

4. The device of claim 2, wherein the removable mounting blocks are foam.

5. The device of claim 1, wherein the wheelchair fender encloses greater than 40% of the tire of the wheelchair.

6. The device of claim 2, wherein the wheelchair fender encloses greater than 40% of the tire of the wheelchair.

7. The device of claim 1, wherein the mounting slots are curved slots.

8. The device of claim 7, wherein the mounting slots exist in matched pairs, providing multiple locations to join the device to the wheelchair.

9. A device for use with a wheelchair, the wheelchair having one or more wheels, each of the one or more wheels having a tire, rim, hand rim, and hub, the device comprising:

a. a vertical wall having a curved top and a flat bottom;
b. an inwardly facing channel following the shape of the curved top;
c. two or more removably mounted foam blocks affixed to the inwardly facing channel;
  i. the two or more removably mounted foam blocks acting to center the device with respect to one of the one or more wheels;
  ii. the two or more removably mounted foam blocks to be removed following installation of the device;
d. one or more curved mounting slots;
  i. the one or more curved mounting slots in the vertical wall;
  ii. the one or more curved mounting slots having a shape that follows the curve of the curved top of the vertical wall.

10. The device of claim 9, wherein a. the inwardly facing channel extends outwardly a sufficient distance to bridge a gap between the rim and the hand rim;
b. whereby a user's fingers are prevented from passing into the gap and being harmed.

11. The device of claim 9, wherein when in use, the device encloses greater than 40% of the wheelchair tire.

* * * * *